US010064438B2

(12) United States Patent
Korver et al.

(10) Patent No.: US 10,064,438 B2
(45) Date of Patent: Sep. 4, 2018

(54) EXERCISE TIGHTS

(71) Applicant: RYU Apparel Inc., Vancouver (CA)

(72) Inventors: Juliet Korver, Vancouver (CA); Erin Mcgann, Vancouver (CA)

(73) Assignee: RYU APPAREL INC., Vancouver (CA)

( * ) Notice: Subject to any disclaimer, the term of this patent is extended or adjusted under 35 U.S.C. 154(b) by 0 days.

(21) Appl. No.: 15/359,491

(22) Filed: Nov. 22, 2016

(65) Prior Publication Data

US 2017/0143050 A1 May 25, 2017

Related U.S. Application Data

(60) Provisional application No. 62/258,669, filed on Nov. 23, 2015.

(51) Int. Cl.
*A41D 1/08* (2018.01)
*A41C 1/00* (2006.01)

(52) U.S. Cl.
CPC ..... *A41D 1/08* (2013.01); *A41C 1/003* (2013.01); *A41D 2400/38* (2013.01)

(58) Field of Classification Search
CPC . A41D 1/06; A41D 1/08; A41D 1/086; A41D 27/02; A41D 2400/38
USPC ... 2/401, 403, 406, 407, 400, 228, 227, 236, 2/237, 220, 221, 238, 69, 272; D2/738, D2/731
See application file for complete search history.

(56) References Cited

U.S. PATENT DOCUMENTS

| | | | | |
|---|---|---|---|---|
| 4,989,272 | A * | 2/1991 | Wagner | A41D 1/06 2/227 |
| 2006/0169004 | A1* | 8/2006 | Belluye | A41D 1/084 66/177 |
| 2010/0192284 | A1* | 8/2010 | Simon | A41D 1/06 2/236 |
| 2011/0214216 | A1* | 9/2011 | Zarabi | A41D 27/02 2/69 |
| 2014/0310854 | A1* | 10/2014 | Kianmahd | A41D 1/06 2/237 |
| 2015/0164151 | A1* | 6/2015 | James | A41D 1/06 450/95 |
| 2015/0189935 | A1* | 7/2015 | Rosenhaus | A41D 1/08 2/74 |
| 2017/0143050 | A1* | 5/2017 | Korver | A41D 1/08 |

* cited by examiner

*Primary Examiner* — Gloria Hale
(74) *Attorney, Agent, or Firm* — Snell & Wilmer LLP

(57) ABSTRACT

A way to provide an exercise garment that, without hampering athletic performance, for example by limiting movement, frees a wearer from having to check or worry about rearward appearance.

20 Claims, 3 Drawing Sheets

EXERCISE TIGHTS

CROSS REFERENCE TO RELATED APPLICATIONS

This application claims priority from U.S. Provisional Patent Application Ser. No. 62/258,669 filed on Nov. 23, 2015, entitled EXERCISE TIGHTS, which is expressly incorporated by reference herein to the fullest extent permitted by law.

BACKGROUND OF THE INVENTION

1. Field of the Invention

The present invention relates garments, and in particular exercise garments.

2. Description of Related Art

Physical activity has been shown to improve health and quality of life. Nevertheless, for any number of reasons, people are sometimes less than enthusiastic about engaging in such activity. For some people, this lack of engagement is chronic, and so not only do they miss the present benefits of such activity, but the consequences accumulate and they may become even less likely to engage.

Some people are more likely to engage in physical activity, and engage enthusiastically, when they feel better about themselves, for example when they feel better about their appearance. However, this result can be challenging to achieve in exercise garments, which tend to be quite revealing, for example to promote the free movement demanded by physical activity.

Some such people are particularly interested in how they appear from behind, which can be difficult to ascertain. Other such people are particularly interested in how they appear from in front, and feel most confident with a toned abdominal appearance. Still other such people are particularly interested in how they appear at their midriff, and feel best with a well-sculpted appearance. In this regard, exercise garments that reliably help one to look their best empower the wearer to enthusiastically engage in physical activity.

Accordingly, what is needed is an exercise garment that reliably helps one to look good from these various perspectives, without hampering athletic performance, for example by unduly limiting movement.

SUMMARY OF THE INVENTION

The present invention is directed to this need.

According to one aspect of the present invention, there is provided an apparatus wearable by a wearer having a pelvis, a waist, hips, buttocks, and legs, comprising: a pelvic portion adapted to receive the pelvis of the wearer, the pelvic portion having: a yoke, a belt adjacent the yoke, and a seat adjacent the belt, and respective leg portions that meet at the pelvic portion, each adapted to receive a respective leg of the wearer, wherein the yoke is adapted to contain not only a portion of the waist of the wearer, but also an upper portion of the buttocks of the wearer.

The yoke may taper inward from bottom to top; the taper of the yoke may be curvilinear.

The yoke may be adapted to smoothly bridge the cleft between an upper portion of the buttocks of the wearer.

The yoke may be elongated to extend above the hips of the wearer and be shaped to sculpt the waist of the wearer so as to follow the smooth contouring of the apparatus.

The yoke may be formed from adjacent panels connected together, for example a front panel, a left panel, a back panel and a right panel. The panels may be elastic. For example, the front panel may be compressive and the left panel, the back panel, and the right panel may be expansive. The panels may thus be adapted to provide muscle sense feedback about the position of various parts of the wearer's body throughout exercise movements.

The belt may be located below the yoke, so as to lie over a portion of the buttocks of the wearer instead of the waist of the wearer. The belt may be adapted to smoothly bridge the cleft between the buttocks of the wearer. In this regard, the yoke may be adapted to bridge the cleft between the buttocks of the wearer more smoothly than the belt bridges the cleft between the buttocks of the wearer.

The belt may be adapted to cover only a posterior portion of the wearer and not fully encircle the wearer. The belt may have a variable width, a bottom edge of the belt being positioned further from a top edge of the belt at the ends of the belt than at the middle of the belt. This variable width may be curvilinear.

The seat may be adapted to contain a lower portion of the buttocks of the wearer. The seat may be adapted to follow the contours of the buttocks, to follow the cleft between the buttocks, or to follow the junction between the bottom of the buttocks and the top of the legs.

Further aspects and advantages of the present invention will become apparent upon considering the following drawings and description.

DESCRIPTION OF THE INVENTION

The invention will be more fully illustrated by the following detailed description of non-limiting specific embodiments in conjunction with the accompanying drawing figures. In the figures, similar elements and/or features may have the same reference label. Further, various elements of the same type may be distinguished by following the reference label with a second label that distinguishes among the similar elements. If only the first reference label is identified in a particular passage of the detailed description, then that passage describes any one of the similar elements having the same first reference label irrespective of the second reference label.

1. BRIEF DESCRIPTION OF THE DRAWINGS

2. DETAILED DESCRIPTION OF SPECIFIC EMBODIMENTS

(a) Structure of Specific Embodiments

Figures 1, 2, 3:
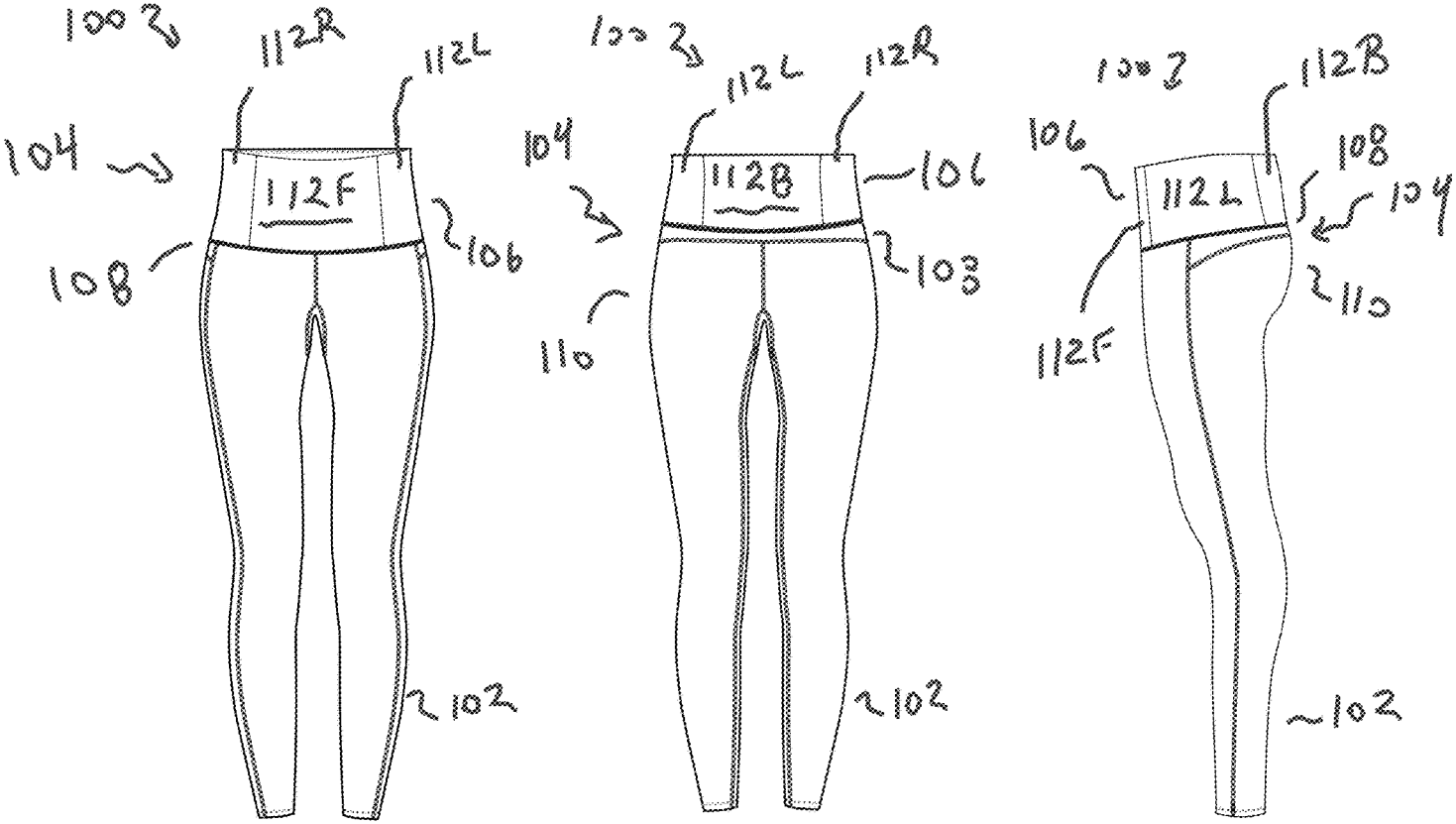
FIG. 1 is a front elevation view of one embodiment of a pair of tights in accordance with aspects of the present invention.
FIG. 2 is a rear elevation view of the tights of FIG. 1.
FIG. 3 is a left side elevation view of the tights of FIG. 1.
Figure 4:
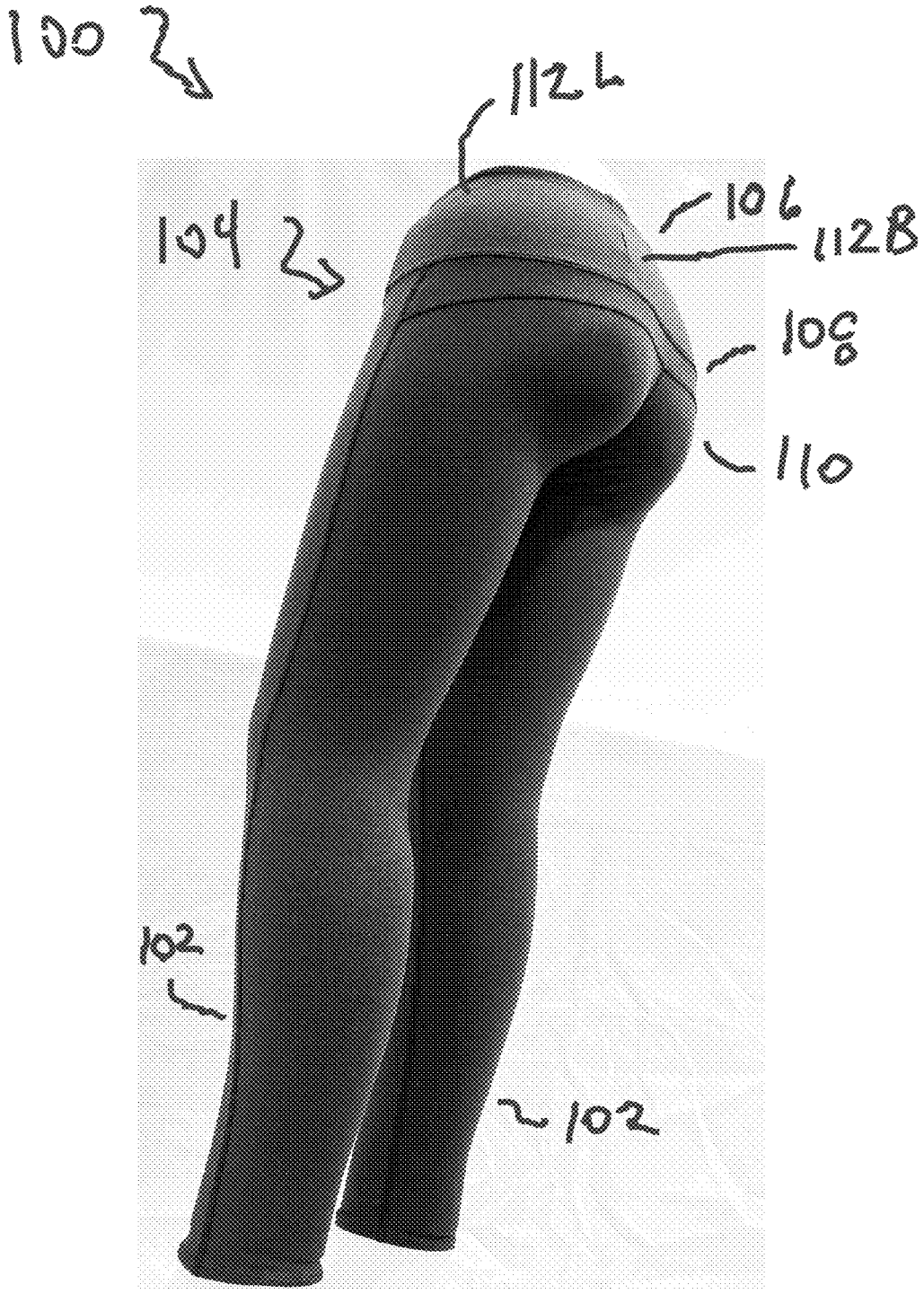
FIG. 4 is a bottom, rear, left oblique view of the tights of FIG. 1.
Figure 5:
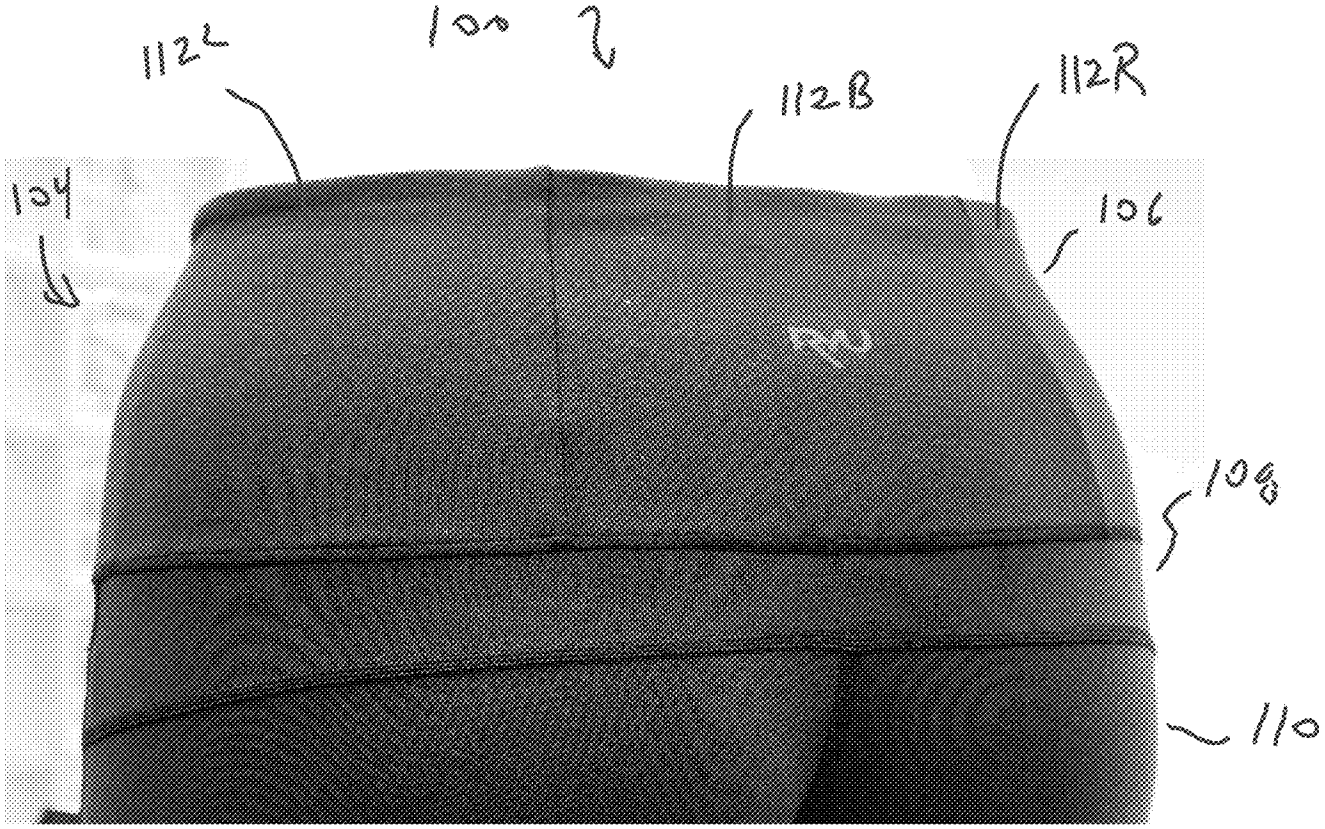
FIG. 5 is a rear, left oblique detail view of the tights of FIG. 1.

FIGS. 1-5 show a pair of exercise tights 100 according to one embodiment of the present invention. The tights 100 have two leg portions 102, which meet at a pelvic portion 104, which includes a yoke 106, a belt 108, and a seat 110.

Table of Parts

| # | Name | Name | # |
|---|---|---|---|
| 100 | tights | back panel | 112B |
| 102 | leg portions | belt | 108 |
| 104 | pelvic | front panel | 112F |
| | portion | left panel | 112L |
| 106 | yoke | leg portions | 102 |
| 108 | belt | panel | 112 |
| 110 | seat | pelvic | 104 |
| 112 | panel | portion | |
| 112B | back panel | right panel | 112R |
| 112F | front panel | seat | 110 |
| 112L | left panel | tights | 100 |
| 112R | right panel | yoke | 106 |

The yoke 106 tapers inward from bottom to top and resembles a conventional high waist; however, it is sized and located so as to contain not only a portion of the waist of the wearer, but also an upper portion of the buttocks. As illustrated, the tapering is curvilinear; however, those skilled in the art will recognize that other arrangements would also work. The yoke 106 is configured to smoothly bridge the cleft between the upper portion of the buttocks, so as not to draw attention to it.

The yoke 106 is elongated to extend well above the wearer's hips and shaped to sculpt the wearer's waist so as to follow the smooth contouring of the tights 100.

The yoke 106 may be formed from adjacent panels 112 connected together, for example to provide desired contouring. For example, as illustrated the yoke 106 may include a front panel 112F, a left panel 112L, a back panel 112B and a right panel 112R.

The characteristics of the panels 112 may vary with design intent and different panels 112 in the yoke 106 may have different characteristics. For example, different panels 112 may have different amounts of elasticity, and that elasticity may be biased differently between allowing expansion and urging compression. For example, one embodiment might provide a compressive front panel 112F and an expansive right panel 112R, back panel 112B and left panel 112L, so as promote free movement by providing slack at the wearer's waist while toning the wearer's abdomen in toward the wearer's core.

Those skilled in the art will appreciate that sculpting and toning, as provided by the yoke 106 and more broadly the tights 100, help a wearer to exercise more effectively by providing muscle sense feedback about the position of various portions of the wearer's body throughout exercise movements.

The belt 108 is located below the yoke 106, so as to lie over a portion of the wearer's buttocks, and thus below the waist as would otherwise be conventional for a belt. The belt 108 thus contains a portion of the buttocks and is configured to smoothly bridge the cleft between the buttocks; however as illustrated, the belt 108 may bridge less smoothly than the yoke 106.

As illustrated, the belt 108 covers only a posterior portion of the wearer and does not fully encircle the wearer. As illustrated, the belt 108 has a variable width, the bottom edge of the belt 108 being positioned further from the top edge of the belt 108 at its ends than its middle, this divergence being curvilinear as illustrated. Those skilled in the art will recognize that these illustrated particulars might be replaced by other arrangements without departing from the spirit of the invention.

The seat 110 contains a lower portion of the buttocks and is configured to follow the contours of the buttocks, including following the cleft between the buttocks and the junction between the bottom of the buttocks and the top of the legs.

Those skilled in the art will recognize that the leg portions 102 flow smoothly into the seat 110 from the rear, but from the front abut the yoke 106.

So configured, the tights 100 modestly contain a portion of the buttocks within the yoke 106 and the belt 108 and provide for comfortable movement for exercise and other physical activity.

(b) Operation of Specific Embodiments

With reference now to FIGS. 1-5, the operation of the above-described embodiments of the invention will now be described.

In operation, a wearer would insert legs into the leg portions 102 of the exercise tights 100 and then draw the pelvic portion 104 of the exercise tights 100 toward the pelvis.

The wearer would then be free to carry out physical activity, with the exercise tights 100 providing for comfortable movement and muscle sense feedback, while also modestly containing a portion of the buttocks within the yoke 106 and the belt 108, sculpting the wearer's waist with the yoke 106, and providing slack at the wearer's waist with the right panel 112R, back panel 112B and left panel 112L, while toning the wearer's abdomen in toward the wearer's core with the front panel 112F, so that the wearer is empowered to enthusiastically engage in the physical activity.

(c) Description Summary

Thus, it will be seen from the foregoing embodiments and examples that there has been described a way to provide an exercise garment that, without hampering athletic performance, for example by limiting movement, frees a wearer from having to check or worry about rearward appearance.

Those skilled in the art will recognize that any portion of the tights 100 may be formed using more than one layer of material, each layer having different characteristics, each layer cooperating with the other layers to provide the characteristics of the portion as a whole.

While specific embodiments of the invention have been described and illustrated, such embodiments should be considered illustrative of the invention only and not as limiting the invention. It will be understood by those skilled in the art that various changes, modifications and substitutions can be made to the foregoing embodiments without departing from the principle and scope of the invention expressed in the claims made herein.

The invention claimed is:

1. A pants garment wearable by a wearer having a pelvis, a waist, hips, buttocks, and legs, comprising:

a. a pelvic portion for receiving the pelvis of the wearer, the pelvic portion having:
   i. a yoke,
   ii. a belt adjacent and connected to the yoke, and
   iii. a seat adjacent and connected to the belt, and b. respective leg portions that meet at and are connected to the pelvic portion, each for receiving a respective leg of the wearer, wherein the yoke contains not only a portion of the waist of the wearer, but also a portion of the buttocks of the wearer, wherein the yoke tapers inward from bottom to top toward the center of the wearer, and wherein the taper of the yoke is curvilinear.

2. A garment as claimed in claim 1, wherein the yoke bridges the cleft between the portion of the buttocks of the wearer.

3. A garment as claimed in claim 1, wherein the yoke is elongated to extend above the hips of the wearer.

4. A pants garment wearable by a wearer having a pelvis, a waist, hips, buttocks, and legs, comprising:

a. a pelvic portion for receiving the pelvis of the wearer, the pelvic portion having:

i. a yoke, ii. a belt adjacent and connected to the yoke, and iii. a seat adjacent and connected to the belt, and b. respective leg portions that meet at and are connected to the pelvic portion, each for receiving a respective leg of the wearer, wherein the yoke contains not only a portion of the waist of the wearer, but also a portion of the buttocks of the wearer, and wherein the yoke is formed from adjacent panels connected together.

5. A garment as claimed in claim 4, wherein the yoke is formed from a front panel, a left panel, a back panel and a right panel.

6. A garment as claimed in claim 5, wherein the panels are elastic.

7. A garment as claimed in claim 6, wherein the front panel is compressive and the left panel, the back panel, and the right panel are expansive in comparison to the front panel.

8. A garment as claimed in claim 7, wherein the compressive and expansive panels provide feedback about the position of various parts of the wearer's body throughout exercise movements.

9. A pants garment wearable by a wearer having a pelvis, a waist, hips, buttocks, and legs, comprising:

a. pelvic portion for receiving the pelvis of the wearer, the pelvic portion having:

i. a yoke, ii. a belt adjacent and connected to the yoke, and iii. a seat adjacent and connected to the belt, and b. respective leg portions that meet at and are connected to the pelvic portion, each for receiving a respective leg of the wearer, wherein the yoke contains not only a portion of the waist of the wearer, but also a portion of the buttocks of the wearer, and wherein the belt is located below the yoke, so as to lie below the waist of the wearer, wherein the belt bridges the cleft between the buttocks of the wearer, and wherein the yoke bridges the cleft between the buttocks of the wearer more smoothly than the belt bridges the cleft between the buttocks of the wearer.

10. A garment as claimed in claim 9, wherein the belt covers only a posterior portion of the wearer and does not fully encircle the wearer.

11. A garment as claimed in claim 9, wherein the belt has a variable width, a bottom edge of the belt being positioned further from a top edge of the belt at either end of the belt than at a middle of the belt.

12. A garment as claimed in claim 11, wherein the variable width of the belt is curvilinear.

13. A garment as claimed in claim 1, wherein the seat contains a lower portion of the buttocks of the wearer.

14. A garment as claimed in claim 13, wherein the seat follows contours of the buttocks.

15. A garment as claimed in claim 14, wherein the seat follows the cleft between the buttocks.

16. A garment as claimed in claim 14, wherein the seat follows the junction between the buttocks and the legs.

17. A garment as claimed in claim 4, wherein the seat contains a lower portion of the buttocks of the wearer.

18. A garment as claimed in claim 13, wherein the seat follows contours of the buttocks.

19. A garment as claimed in claim 14, wherein the seat follows the cleft between the buttocks.

20. A garment as claimed in claim 14, wherein the seat follows the junction between the buttocks and the legs.

* * * * *